US009112307B2

(12) United States Patent
Leroyer et al.

(10) Patent No.: US 9,112,307 B2
(45) Date of Patent: Aug. 18, 2015

(54) CONNECTOR LOCKING SYSTEM USING A TEMPERATURE RESPONSIVE SPRING

(71) Applicant: SOURIAU, Versailles Cedex (FR)

(72) Inventors: Serge Leroyer, Le Mans (FR); Pascal Ribeau, Le Mans (FR); Olivier Pasco, Le Mans (FR)

(73) Assignee: SOURIAU, Versailles (FR)

( * ) Notice: Subject to any disclaimer, the term of this patent is extended or adjusted under 35 U.S.C. 154(b) by 104 days.

(21) Appl. No.: 14/072,820

(22) Filed: Nov. 6, 2013

(65) Prior Publication Data

US 2014/0127929 A1 May 8, 2014

(30) Foreign Application Priority Data

Nov. 6, 2012 (FR) ..... 12 60545

(51) Int. Cl.
*H01R 4/50* (2006.01)
*H01R 13/639* (2006.01)
*H01R 13/627* (2006.01)

(52) U.S. Cl.
CPC ..... *H01R 13/639* (2013.01); *H01R 13/6276* (2013.01); *H01R 2201/26* (2013.01); *Y10T 403/21* (2015.01)

(58) Field of Classification Search
CPC ..... H01R 13/6276
USPC ..... 439/345, 346, 348, 180; 285/82
See application file for complete search history.

(56) References Cited

U.S. PATENT DOCUMENTS 3,343,852 A * 9/1967 Blight et al. ..... 285/82
3,385,613 A * 5/1968 McCall ..... 285/84
3,626,355 A * 12/1971 Nudelmont ..... 439/103
3,693,136 A * 9/1972 Appleton ..... 439/346
3,832,674 A * 8/1974 Florian ..... 439/281
3,881,954 A 5/1975 Maskalick
4,621,882 A * 11/1986 Krumme ..... 439/161
5,161,738 A * 11/1992 Wass ..... 236/92 C
5,393,239 A * 2/1995 Ursich ..... 439/180
5,505,632 A * 4/1996 Hayashi et al. ..... 439/318

(Continued)

FOREIGN PATENT DOCUMENTS

CN 201323313 Y 10/2009
FR 2 288 211 A1 6/1974
FR 2 961 883 A1 12/2011

OTHER PUBLICATIONS

French Search Report, dated Jul. 3, 2013, from corresponding French application.

*Primary Examiner* — Vanessa Girardi
(74) *Attorney, Agent, or Firm* — Young & Thompson

(57) ABSTRACT

A secure locking system includes: a case (10) having at least one transverse orifice (33) that opens to the surface of the case; a locking ring (20) having a notched wall (22), which can be locked at one end of the case; a spring (31) housed in the orifice of the case; a ball (32) installed at least partially in the orifice of the case, above the spring. The spring is made of a shape-memory material, which assumes: an elastic state when an environmental temperature is less than or equal to a critical temperature of the shape-memory material, this elastic state enabling movement of the ball in the orifice; or a hardened state when an environmental temperature is higher than the critical temperature of the shape-memory material, this hardened state preventing any movement of the ball in the orifice. A connector and connector assembly including the locking system are described.

13 Claims, 1 Drawing Sheet

(56) References Cited

U.S. PATENT DOCUMENTS

| | | | | |
|---|---|---|---|---|
| 6,761,469 | B2 * | 7/2004 | Wu | 362/655 |
| 7,125,273 | B2 * | 10/2006 | Irwin et al. | 439/180 |
| 7,681,804 | B2 * | 3/2010 | Lockhart | 236/93 A |
| 7,775,272 | B2 * | 8/2010 | Nelson et al. | 166/241.6 |
| 7,878,840 | B2 * | 2/2011 | Hankey et al. | 439/348 |
| 8,757,505 | B2 * | 6/2014 | Negishi et al. | 236/12.11 |
| 2005/0199845 | A1 * | 9/2005 | Jones et al. | 251/129.06 |
| 2006/0121956 | A1 * | 6/2006 | Lee | 455/574 |
| 2009/0072575 | A1 * | 3/2009 | Browne et al. | 296/97.7 |
| 2011/0318098 | A1 | 12/2011 | Gloaguen et al. | |

* cited by examiner

CONNECTOR LOCKING SYSTEM USING A TEMPERATURE RESPONSIVE SPRING

FIELD OF THE INVENTION

The invention relates to a secure locking system that makes it possible to lock the system in locked position when the surrounding temperature is high and to unlock it when the environment is at ambient temperature.

The invention also relates to an electrical connector and a connector assembly comprising such a locking system.

The invention has applications in all fields requiring the locking of a case onto another element. Particularly, it has applications in the field of connectors, and, in particular, in the fields of aeronautical and automobile connectors, where the connectors are often subjected to strong vibrations in environments at more than 150 degrees Celsius.

STATE OF THE ART

With connectors, an assembly of two connection elements (for example, a male connection element and a female connection element) coupled with one another for ensuring an electrical connection is called a "connector assembly." Each of the connection elements comprises one or more electric contacts (male or female) that can be fitted together with complementary electric contacts of the other connection element.

In certain applications, particularly in the fields of aeronautical or automobile connectors, the strong environmental vibrations produce movements of the connection elements in relation to one another. These movements can cause a loss of electrical connection between said connection elements of the same connector assembly.

To prevent any movement of a connection element relative to another, it is known to provide each connector assembly with a locking system that makes it possible to lock the connection between the two connection elements and thus to prevent unwanted disconnections. Such a locking system must make it possible to maintain the connection, even when the connector assembly is subjected to vibrations.

To do this, it is known to install a locking system around one of the connection elements so as to lock each connection element relative to the other connection element of the same connector assembly. Different locking systems currently exist. The most well-known system consists of a generally cylindrical locking ring mounted at the end of one of the connection elements so as to keep the two connection elements joined. This locking ring is generally a hollow and short cylinder, hereafter called a ring, equipped with a first holding means intended to hold the ring free in rotation on a first connection element and with a second holding means intended to hold the ring on the second connection element of the connector assembly.

Among locking rings, there are locking rings whose second holding means is a screw thread that makes it possible to screw said ring on the connection elements, made at the inner wall of the ring.

This screw thread is not always sufficient to ensure a hold of the connection during vibrations; also, there are locking rings whose second holding means is completed by a series of notches intended to be arranged around a locking element. These notches are also made at the inner wall of the ring, which is provided with a series of notches intended to be arranged around a locking element. The locking element can then be a simple locking pin or else a ball-and-spring predominant device. In this second variant, the locking element generally comprises an orifice that opens to the surface of the connection element and that forms a transverse housing. The locking element also comprises a spring placed crosswise in the orifice that opens out, i.e., placed perpendicular to the direction of the electric contacts of the connection element. This locking element further comprises a ball placed above the spring so as to be partially in the housing. This ball is positioned so as to be partially in the housing when the spring is relaxed and totally in the housing when the spring is compressed. In this variant, the locking ring is mounted at the end of the connection element so as to be able to cover the housing.

During the locking of the system, the operator subjects the locking ring to a movement of rotation around the connection element. The inner wall of the locking ring slides, notch by notch, around the end of the connection element and therefore around the locking element. Thus, the notched inner wall of the locking ring causes a movement of the ball in its housing. This movement is induced by the notches of the locking ring. Actually, each notch is an asymmetrical tooth, in the approximate shape of a right triangle. Each notch therefore comprises a low side of small height and a high side of greater height. The height of the high side is approximately equal to the height of the part of the ball that projects beyond the housing. Thus, when the locking ring is in rotation, the low side of the notches presses against the ball, which compresses the spring. The ball then finds itself totally housed in its housing and does not project beyond said housing. As the locking ring continues to slide, the high side of the notches is found opposite the ball that can then go partly outside the housing under the effect of the relaxation of the spring. When the ball is partially outside its housing, it is locked in the notch of the locking ring, ensuring the locking of the connector assembly.

However, under extreme conditions and particularly with strong vibrations or with strong bumps at high temperature, it happens that the spring is inadvertently compressed, driving the ball into the housing, which makes it possible for the notches of the locking ring to slide so as to unlock said ring. Such extreme conditions are encountered, for example, in the field of the automobile, when a vehicle goes over a pothole or any other hole in the road, or in the field of aeronautics, during air pockets in flight or impacts on landing.

DISCLOSURE OF THE INVENTION

The invention has precisely as its object to eliminate the drawbacks of the previously-explained techniques. For this purpose, the invention proposes a ball locking system in which the spring cannot be relaxed when the ambient temperature is high. To do this, the spring is made from a shape-memory material that offers a certain rigidity to the spring when the environment is at a high temperature and a certain elasticity to the spring when the environment is at ambient temperature. In this way, as long as the device on which the locking system is mounted is functioning, ensuring a relatively high environmental temperature, the locking system cannot be unlocked in an untimely fashion. On the contrary, when the environment returns to ambient temperature, the spring finds its elasticity again, making possible a normal unlocking by the operator.

More precisely, the invention relates to a secure locking system comprising:

- a case provided with at least one transverse orifice that opens to the surface of said case,
- a locking ring having a notched wall, which can be locked at one end of the case,
- a spring housed in the orifice of the case, a ball installed at least partially in the orifice of the case, above the spring.

This system is characterized by the fact that the spring is made of a shape-memory material, able to assume:

an elastic state when an environmental temperature is less than or equal to a critical temperature of the shape-memory material, this elastic state making possible a movement of the ball in the orifice, and a hardened state when an environmental temperature is higher than a critical temperature of the shape-memory material, this hardened state preventing any movement of the ball in the orifice.

This system can comprise one or more of the following characteristics:

the shape-memory material is a near-equiatomic nickel-titanium alloy.

the case has several orifices, each equipped with a spring and a ball.

The invention also relates to a connector comprising a locking system as described above. In such a connector, the case is generally a plug body.

The invention further relates to a connector assembly comprising a first connection element and a second connection element that can be connected with one another. This connector assembly is characterized by the fact that it comprises a locking system as described above, in which the case is a plug body or a receptacle body of one of the connection elements and the locking ring ensures the locking of the first connection element with the second connection element.

Advantageously, the receptacle body or the plug body of each connection element of this connector assembly comprises at least one orifice in which a spring and a ball are housed, a single locking ring ensuring a locking of each of the balls in its orifice.

DETAILED DESCRIPTION OF EMBODIMENTS OF THE INVENTION

Figure 1:
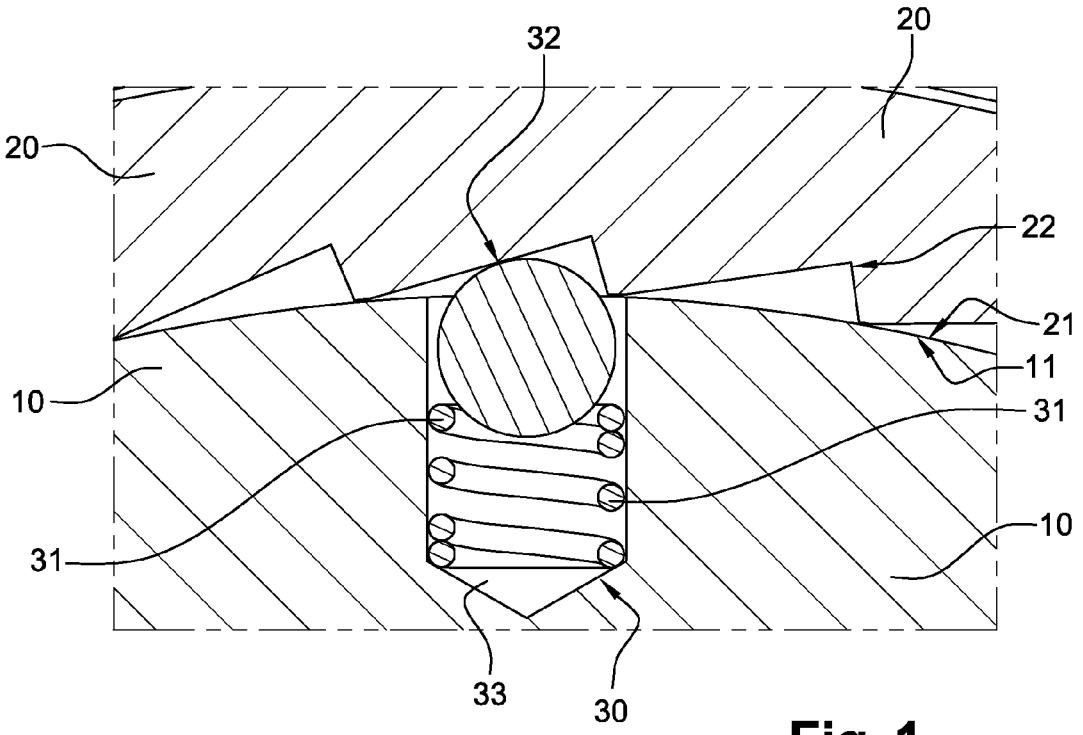
FIG. 1 shows a cutaway view of the locking system with a ball-and-spring predominant device according to the invention, when the environmental temperature is high.

The invention relates to a locking system with a ball-and-spring predominant device that makes it possible to ensure a secure locking as long as the device that supports the locking system is operating. An example of this locking system is shown in FIG. 1.

This locking system comprises a locking ring 20 having an inner wall 21 provided with asymmetrical notches 22. This locking ring 20 is a standard ring of the type of the locking ring having a notched wall described above.

This locking system further comprises a ball-and-spring predominant device 30. This predominant device 30 is housed in a housing 33 made in a case 10 around which the locking ring 20 is mounted. This case 10 can be a part of the device supporting the locking system. However, it is an integral part of the locking system since it comprises the housing 33 intended to receive the predominant device 30. This housing 33 is an orifice that opens to the surface of the wall 11 of the case 10. This orifice is made crosswise in the case 10, that is to say that it is perpendicular to the wall 11 of the case 10. In the case that will be described in greater detail hereafter where the case is a plug body of an electrical connector, then the orifice is perpendicular to the direction of the electric contacts mounted inside the plug body.

According to the invention, the predominant device 30 comprises a spring 31 and a ball 32. The spring 31 is installed in the housing 33 so as to be crosswise to the wall of the case. The ball 32 is installed above the spring 31, i.e., at the mouth of the orifice. In this way, when the spring is compressed, the ball 32 is entirely housed in the housing 33. In contrast, when the spring is relaxed, the ball 32 is only partially housed in the housing 33; in this case, the part of the ball 32 that is outside of the orifice finds itself imprisoned in a notch 22 of the locking ring 20.

In the invention, the spring 31 of the predominant device is made from a shape-memory material. The shape-memory material can be, for example, a near-equiatomic nickel-titanium alloy. The shape-memory materials have the property of keeping an initial shape in memory and of returning to it even after deformation. Such materials offer the advantage of being able to alternate two shapes or two behaviors when the temperature of the environment varies around a critical temperature. In particular, shape-memory materials make it possible for the spring 31 to be in an elastic state when the environment is at a temperature that is less than or equal to a critical temperature, for example at ambient temperature, and in a hardened state when the temperature of the environment is higher than the critical temperature. By critical temperature, or TC, is meant the temperature at which the shape-memory material changes state. Certain shape-memory materials such as the nickel-titanium alloys, known under the name Nitinol®, have a critical temperature of around 36° C.

Thus, in the invention, the spring 31 can successively pass from an elastic state to a hardened state. In other words, when the environment is at a temperature that is less than or equal to TC, for example at ambient temperature, then the spring 31 is in an elastic state and can easily pass from a compressed state to a relaxed state, which makes it possible for an operator to lock or unlock the locking ring. In contrast, when the environment is at a high temperature, higher than TC, then the spring 31 is in a hardened state. In its hardened state, the spring 31 is totally spread out in its housing 33; it is no longer able to be compressed. The ball 32 can therefore no longer completely reenter into the housing 33 and remains partially outside of said housing. In this way, the ball 32 is locked between the notch 22 of the locking ring and the hardened spring 31. It is then understood that regardless of what the exterior conditions (extreme vibrations, bumps, etc.) are, the locking ring cannot be unlocked as long as the environmental temperature has not fallen back below the critical temperature. The locking is thus secure.

In a variant of the invention, two or more predominant devices 30 can be distributed over the contour of the case. Such a variant can be particularly advantageous when the diameter of the case is of large size.

According to an embodiment of the invention, the locking system as just described is applied to electrical connectors. In this case, the housing 33 is made in the plug body or the receptacle body of the connector. The predominant device 30 is then perpendicular to the electric contacts mounted in the plug body or receptacle body, and the locking ring 20 turns around the end of said plug body.

It should be noted that in the fields of automobile and aeronautical connectors, the connectors are often in the environment of the engine. Consequently, as soon as the engine is operating, the temperature of the environment increases, easily exceeding the critical temperature. In contrast, as soon as the engine has stopped, the environmental temperature decreases to return to the ambient temperature. Since the operators generally work with a stopped engine, the locking system can be manipulated in the same way as a standard locking system.

Figure 2:
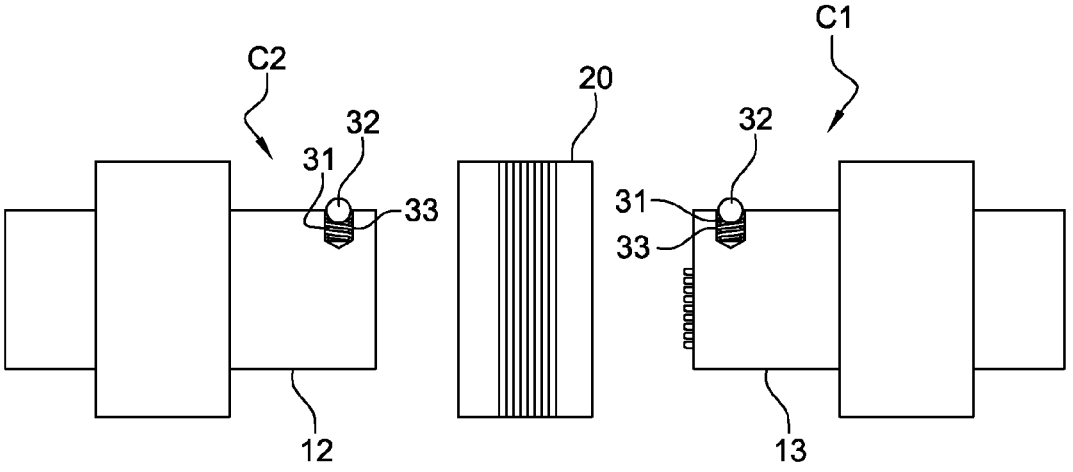
FIG. 2 diagrammatically shows a connector assembly provided with the locking system of FIG. 1.

The locking system can also be mounted between two connection elements C1, C2 of a connector assembly, as shown in FIG. 2. In this case, a housing 33 is made in the plug body 12 or the receptacle body 13 of one of the connection elements and is equipped with a predominant device. In this case, the locking ring 20 has a notched area intended to close the housing 33.

In a variant, a housing 33 is made in the plug body 10 of the connection element C2 or the receptacle body 13 of the connection element C1, and a predominant device 30 is installed in each of these housings 33, perpendicular to the electric contacts of each of the connection elements. The inner wall 21 of the locking ring 20 then has two notched areas, opposite one another, at each end of the hollow cylinder that forms the locking ring. Each notched area, not visible in FIG. 2, ensures the closing of one of the housings 33 and therefore the holding of one of the balls 32.

The system of the invention as just described exhibits the advantage of ensuring reliability in relation to the standard systems that neither necessitates the addition of any part nor modifies the assembly lines of the connectors.

The invention claimed is:

1. Secure locking system comprising:

a case (10) provided with at least one transverse orifice (33) that opens to the surface of said case, a locking ring (20) having a notched wall (22), which can be locked at one end of the case, a spring (31) housed in the orifice (33) of the case, a ball (32) installed at least partially in the orifice (33) of the case, above the spring, characterized in that the spring (31) is made of a shape-memory material, able to assume:

an elastic state when an environmental temperature is less than or equal to a critical temperature of the shape-memory material, this elastic state making possible a movement of the ball in the orifice, or a hardened state when an environmental temperature is higher than a critical temperature of the shape-memory material, this hardened state preventing any movement of the ball in the orifice.

2. Electrical connector, wherein it comprises a locking system according to claim 1, in which the case (10) is a plug body or a receptacle body (12 or 13) of a connector.

3. Connector assembly comprising a first connection element and a second connection element (C1, C2) that can be connected with one another, wherein it comprises a locking system according to claim 1, in which the case (10) is a plug body or a receptacle body (12, 13) of one of the connection elements, and the locking ring (20) ensures the locking of the first connection element (C1) with the second connection element (C2).

4. Connector assembly according to claim 3, wherein the receptacle body or the plug body (12, 13) of each connection element (C1, C2) comprises at least one orifice (33) in which a spring (31) and a ball (32) are housed, a single locking ring (20) ensuring a locking of each of the balls in its orifice.

5. Locking system according to claim 1, wherein the shape-memory material is a near-equiatomic nickel-titanium alloy.

6. Locking system according to claim 5, wherein the case (10) has several orifices (33), each equipped with a spring (31) and a ball (32).

7. Electrical connector, wherein it comprises a locking system according to claim 5, in which the case (10) is a plug body or a receptacle body (12 or 13) of a connector.

8. Connector assembly comprising a first connection element and a second connection element (C1, C2) that can be connected with one another, wherein it comprises a locking system according to claim 5, in which the case (10) is a plug body or a receptacle body (12, 13) of one of the connection elements, and the locking ring (20) ensures the locking of the first connection element (C1) with the second connection element (C2).

9. Connector assembly according to claim 8, wherein the receptacle body or the plug body (12, 13) of each connection element (C1, C2) comprises at least one orifice (33) in which a spring (31) and a ball (32) are housed, a single locking ring (20) ensuring a locking of each of the balls in its orifice.

10. Locking system according to claim 1, wherein the case (10) has several orifices (33), each equipped with a spring (31) and a ball (32).

11. Electrical connector, wherein it comprises a locking system according to claim 10, in which the case (10) is a plug body or a receptacle body (12 or 13) of a connector.

12. Connector assembly comprising a first connection element and a second connection element (C1, C2) that can be connected with one another, wherein it comprises a locking system according to claim 10 in which the case (10) is a plug body or a receptacle body (12, 13) of one of the connection elements, and the locking ring (20) ensures the locking of the first connection element (C1) with the second connection element (C2).

13. Connector assembly according to claim 12, wherein the receptacle body or the plug body (12, 13) of each connection element (C1, C2) comprises at least one orifice (33) in which a spring (31) and a ball (32) are housed, a single locking ring (20) ensuring a locking of each of the balls in its orifice.

* * * * *